US005368289A

United States Patent [19]

Iwaki et al.

[11] Patent Number: 5,368,289

[45] Date of Patent: Nov. 29, 1994

[54] RECORDING SHEET CONVEYING DEVICE

[75] Inventors: Yoshinari Iwaki; Nobuo Hyakutake; Jun Takagi; Noriyoshi Kono; Kunimasa Aoshima; Hiroyuki Otsuka; Akira Ogita; Kouji Hamabe, all of Kanagawa, Japan

[73] Assignee: Fuji Xerox Co., Ltd., Tokyo, Japan

[21] Appl. No.: 223,135

[22] Filed: Apr. 5, 1994

Related U.S. Application Data

[63] Continuation of Ser. No. 879,279, May 7, 1992, abandoned.

[30] Foreign Application Priority Data

May 14, 1991 [JP] Japan ..... 3-137068

[51] Int. Cl.[5] ..... B65H 5/06

[52] U.S. Cl. ..... 271/265; 271/193; 355/309

[58] Field of Search ..... 271/193, 265, 275; 226/94; 355/309

[56] References Cited

U.S. PATENT DOCUMENTS

| | | | |
|---|---|---|---|
| 4,526,357 | 7/1985 | Kuehnle | 271/193 X |
| 4,978,118 | 12/1990 | Kasahara | 271/193 X |
| 5,019,871 | 5/1991 | Takeda | 271/193 X |

*Primary Examiner*—Richard A. Schacher

*Attorney, Agent, or Firm*—Finnegan, Henderson, Farabow, Garrett & Dunner

[57] ABSTRACT

In a recording sheet conveying device comprising: a dielectric.sheet which moves at a predetermined speed while electrostatically retaining a recording sheet on the outer surface thereof; a charger positioned on the side of the inner surface of the dielectric sheet, to induce electrostatic attraction forces between the dielectric sheet and the recording sheet; and a deflector roll having an electrically conductive layer as an outer surface thereof, the deflector roll being confronted with the charger and adapted to push the recording sheet against the dielectric sheet, the number of electric charges provided by the charger is so adjusted that electrostatic attraction forces acting on the rear end portion of the recording sheet are weaker than those acting on the front end portion of the recording sheet, whereby the recording sheet is prevented from being wrinkled when electrostatically retained on the dielectric sheet.

2 Claims, 11 Drawing Sheets

RECORDING SHEET CONVEYING DEVICE

This application is a continuation of application Ser. No. 07/879,279, filed May 7, 1992, now abandoned.

BACKGROUND OF THE INVENTION

This invention relates to a recording sheet conveying device, for instance, in a laser printer or electrophotographic copying machine which is adapted to convey a recording sheet while holding it in place, and more particularly to a recording sheet conveying device which is adapted to convey a recording sheet while retaining it in place using an electrostatic attraction force.

For instance in a color copying machine, monochromatic toner images of yellow, cyan and magenta formed on its photo-sensitive drum are transferred on a recording sheet one after another, to form a full-color image on it. For this purpose, it is necessary for the color copying machine to have a recording sheet conveying device to send one and the same recording sheet to a toner image transferring section repeatedly. A conventional recording sheet conveying device of this type is such that an electrostatic attraction force is used to retain a recording sheet on a dielectric sheet which is wound on a rotary drum.

An example of the conventional recording sheet conveying device is as outlined in FIG. 18. In FIG. 18, reference character a designates a dielectric sheet on which a recording sheet b is retained so as to be conveyed; c, a charger arranged on the side of the inner surface of the dielectric sheet a and connected to a DC power source d; and e, an electrically conductive deflector roll which is confronted through the dielectric sheet with the charger to push the recording sheet against the outer surface of the dielectric sheet.

The recording sheet b is retained on the dielectric sheet a as follows: When the recording sheet b passes through the gap between the dielectric sheet a and the deflector roll e, the charger is activated to charge the inner surface of the dielectric sheet a (positive charges being injected thereinto in the case of FIG. 18), as a result of which charges opposite in polarity those on the inner surface (negative charges in the case of FIG. 18) flow into the outer surface of the dielectric sheet through the deflector roll. Hence, electrostatic attraction forces are induced between the dielectric sheet and the recording sheet b, so that the latter b is electrostatically attracted to and retained on the dielectric sheet a.

Heretofore, while the recording sheet b is passing through the gap between the dielectric sheet a and the deflector roll e, the charger c is kept activated so that the electrostatic attraction forces act on the whole area of the recording sheet b.

When the electrostatic attraction forces act on the whole area of the recording sheet as was described above, the recording sheet is liable to be wrinkled. This phenomenon is significant particularly in the case where the recording sheet deformed by moisture is to be retained on the dielectric sheet.

This difficulty is serious with a recording sheet conveying device which is used to convey a recording sheet to the toner image transferring section. That is, if a recording sheet sent to the transferring section has been wrinkled, part of the toner image may not be transferred from the photo-sensitive drum onto the recording sheet because of the wrinkles. Accordingly, the resultant image is unsatisfactory in picture quality, having blank parts. Thus, the copying machine or printer with the recording sheet conveying device would be unreliable in operation.

SUMMARY OF THE INVENTION

In view of the foregoing, an object of this invention is to provide a recording sheet conveying device which can electrostatically retain a recording sheet on a dielectric sheet without wrinkling it.

In order to achieve the above-described object, the inventors have conducted intensive research on a recording sheet conveying device, and found the following technical means: those technical means have been developed on the basis of a recording sheet conveying device which comprises a dielectric sheet which moves at a predetermined speed while electrostatically retaining a recording sheet on the outer surface thereof; a charger positioned on the side of the inner surface of the dielectric sheet, to induce electrostatic attraction forces between the dielectric sheet and the recording sheet; and a deflector roll having an electrically conductive layer as its outer surface, the deflector roll being confronted with the charger and adapted to push the recording sheet against the dielectric sheet. In the following description of these technical means, description of the arrangement of the recording sheet conveying device again will be omitted.

A specific feature of a first technical means resides in control means provided for adjusting the number of electric charges outputted by the charger so that the electrostatic attraction forces acting on the front end portion of the recording sheet are weaker than those acting on the rear end portion.

As was described above, according to the first technical means, the electrostatic attraction forces acting on the front end portion of the recording sheet are weaker than those acting on the rear end portion. Hence, the recording sheet is electrostatically attracted to and retained on the dielectric sheet in such a manner that it is stretched from its front end portion toward its rear end portion. Therefore, the recording sheet is effectively prevented from being wrinkled when electrostatically retained on the dielectric sheet.

In order that the electrostatic attraction forces acting on the front end portion of the recording sheet are made weaker than those acting on the rear end portion as was described above, the charge may be controlled as follows: after the front end portion of the recording sheet has been electrostatically retained on the dielectric sheet, the charger is stopped or the voltage applied to the charger is gradually decreased.

A specific feature of a second technical means resides in that the deflector roll is movable into and out of engagement with the dielectric sheet, and it is moved away from the recording sheet after the front end portion of the recording sheet has been electrostatically attracted to and retained on the dielectric sheet.

According to the second technical means, after the front end portion of the recording sheet has been electrostatically attracted to and retained on the dielectric sheet, the deflector roll is moved away from the recording sheet. Therefore, the electrostatic attraction forces act only on the front end portion of the recording sheet, not on the rear end portion. Hence, the rear end portion of the recording sheet is placed in close contact with the dielectric sheet following the front end portion. Thus, the recording sheet is prevented from being wrinkled when retained on the dielectric sheet.

In a third technical means, the electrically conductive layer of the deflector roll is in the form of a belt, in a part of the outer surface thereof, which is extended longitudinally of the deflector roll.

According to the third technical means, the electrostatic attraction forces act only on the part of the recording sheet which is brought into contact with the belt-shaped conductive layer of the deflector roll. Hence, as the deflector roll is turned in such a manner that the belt-shaped conductive layer is brought into contact with the front end portion of the recording sheet, the rear end portion of the latter is placed in close contact with the dielectric sheet in such a manner that it is stretched by the deflector roll. Thus, the recording sheet is prevented from being wrinkled when retained on the dielectric sheet.

In a fourth technical means, the electrically conductive layer is in the form of a ring surrounding the middle of the deflector roll.

According to the fourth technical means, similarly as in the case of the third technical means, the electrostatic attraction forces act only on the part of the recording sheet which is brought into contact with the ring-shaped conductive layer of the deflector roll. Therefore, the recording sheet is placed in close contact with the dielectric sheet in such a manner that it is stretched outwardly from the middle. Thus, the recording sheet is effectively prevented from being wrinkled when retained on the dielectric sheet.

In a fifth technical means, a precedence electrode is provided on one side of the deflector roll where the latter receives the recording sheet, in such a manner that the precedence electrode confronts the middle of the deflector roll.

According to the fifth technical means, the electrostatic attracting forces act on the middle, in the direction of width, of the recording sheet when the latter goes into the gap between the precedence electrode and the dielectric sheet, and then on the whole area of the recording sheet when the latter goes into the gap between the dielectric sheet and the deflector roll. That is, the middle, in the direction of width, of the recording sheet is first electrostatically attracted to and retained on the dielectric sheet. Therefore, in this case, too, the recording sheet is placed in close contact with the dielectric sheet in such a manner that it is stretched outwardly from the middle. Thus, the recording sheet is positively prevented from being wrinkled when retained on the dielectric sheet.

In a sixth technical means, a regulating plate of insulating material is provided on the side of the inner surface of the dielectric sheet in such a manner that the regulating plate covers part of the charger and abuts against the dielectric sheet, and it has a cut or through-hole in its one side portion at the middle as viewed longitudinally of said regulating plate, to allow the passage of electric charges provided by the charger.

According to the sixth technical means, electric charges are injected more in the middle portion of the dielectric sheet through the cut or through-hole than the remaining portions, and therefore the recording sheet is electro-statically attracted to and retained on the dielectric sheet beginning with its middle portion on which the electrostatic attraction forces act strongly. That is, the recording sheet is placed in close contact with the dielectric sheet in such a manner that it is stretched outwardly from the middle. Thus, the recording sheet is positively prevented from being wrinkled when retained on the dielectric sheet.

In a seventh technical means, a regulating plate of insulating material is provided on the side of the inner surface of the dielectric sheet in such a manner that it covers part of the charger and abuts against the dielectric sheet, and the regulating plate has a protrusion extended from the middle of its one side to abut against the dielectric sheet.

According to the seventh technical means, the middle portion of the dielectric sheet is curved towards the deflector roll by the protrusion of the regulating plate, so that the recording sheet is electrostatically attracted to and retained on the dielectric sheet beginning with its middle portion as viewed in the direction of width. Hence, similarly as in the case of the fifth or sixth technical means, the recording sheet is placed in close contact with the dielectric sheet in such a manner that it is stretched outwardly from the middle. Thus, the recording sheet is effectively prevented from being wrinkled when retained on the dielectric sheet.

In summary of the above-described technical means, the recording sheet is electrostatically attracted to and retained on the dielectric sheet in such a manner that it is stretched from its front end portion towards its rear end portion or outwardly from its middle portion. Hence, the recording sheet is positively prevented from being wrinkled when retained on the dielectric sheet.

The nature, utility and principle of the invention will be more clearly understood from the following detailed description and the appended claims when read in conjunction with the accompanying drawings.

DETAILED DESCRIPTION OF THE PREFERRED EMBODIMENTS

Preferred embodiments of this invention will be described with reference to the accompanying drawings.

As conducive to a full understanding of the invention, first the arrangement of a color laser printer including a recording sheet conveying device which concerns the embodiments of the invention (described later) will be described with reference to FIG. 17.

The color laser printer is designed as follows: A monochromatic toner image formed every revolution of a photosensitive drum 51 is transferred onto a recording sheet 5 held on a transfer drum 10. This operation is carried out for each of four colors, yellow, magenta, cyan and black, to obtain a full-color image. That is, after being held on the transfer drum 10, the recording sheet 5 is sent to the toner image transferring section repeatedly, and after the toner images of four colors have been printed on the recording sheet 5, the latter 5 is removed from the transfer drum 10.

Now, the recording sheet conveying device in the laser printer thus designed will be described.

Figure 16:
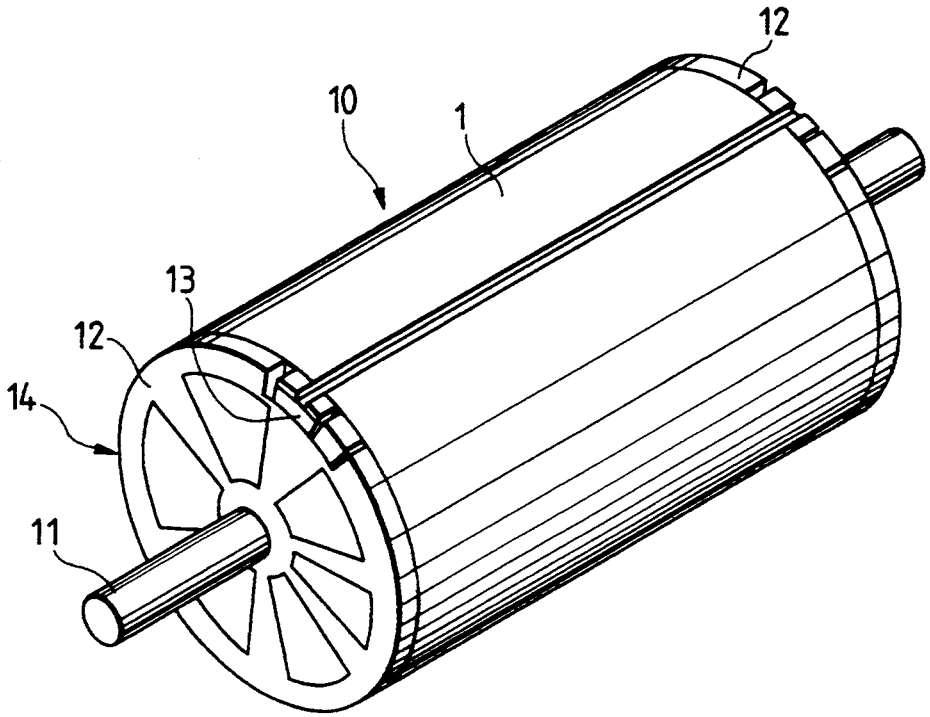
FIG. 16 is a perspective view showing a transfer drum in a recording sheet conveying device.

As shown in FIG. 16, the above-described transfer drum 10 comprises: a drum body 14; and a dielectric sheet 1. The drum body 14 is formed as follows: A pair of ring-shaped members 12 and 12 are fixedly mounted on a rotary shaft 11 with a predetermined distance therebetween. A portion of the outer periphery of one of the ring-shaped members 12 is connected to a portion of the outer periphery of the other ring-shaped member 12 with a tie plate 13, to form the drum body 14. The dielectric sheet 1 is wound on the drum 14 thus formed. Electrostatic attraction forces are utilized to retain the recording sheet 5 on the dielectric sheet 1.

Referring back to FIG. 17, the recording sheet 5 is electrostatically retained on the dielectric sheet 1 by means of a charger 2 (hereinafter referred to as "an attracting corotron 2", when applicable) and a deflector roll 3 which is confronted through the dielectric sheet 1 with the attracting corotron 2. That is, when the attracting corotron 2 is activated to induce corona discharges, electric charges are provided on the inner surface of the dielectric sheet 1, while electric charges opposite in polarity to the aforementioned charges are injected into the outer surface of the dielectric sheet 1 through an electrically conductive layer 31 forming the surface of the deflector roll 3, so that electrostatic attraction forces are induced between the recording sheet 5 and the dielectric sheet 1. In FIG. 17, reference numeral 4 designates a regulating plate made of an insulating material which supports the dielectric sheet 1 from inside at the position where the recording sheet 5 is electrostatically retained. The regulating plate 4 is arranged in such a manner as to cover a part of the attracting corotron 2.

Figure 17:
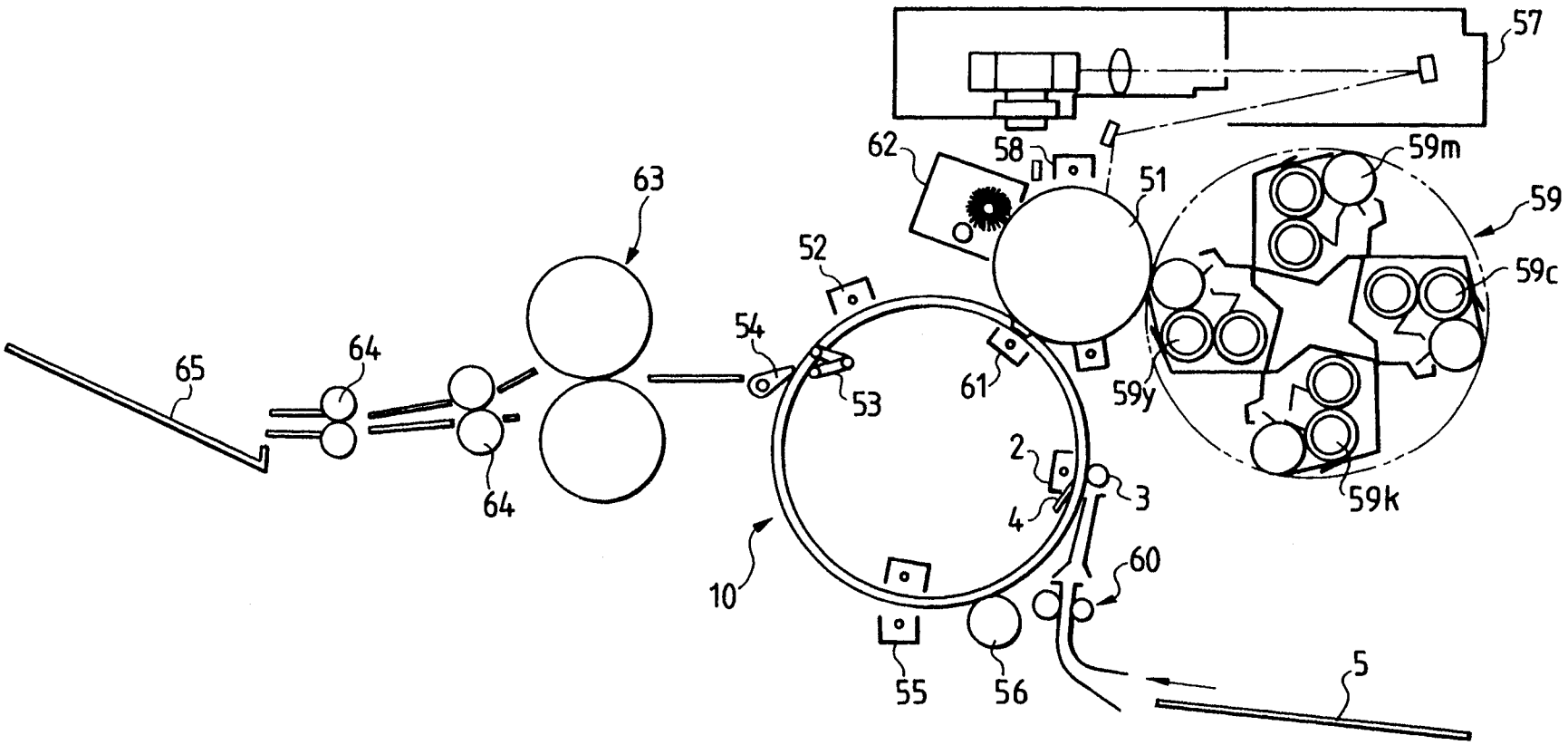
FIG. 17 is an explanatory diagram showing the arrangement of a color printer to which the recording sheet conveying device of the invention may be applied.
Figure 18:
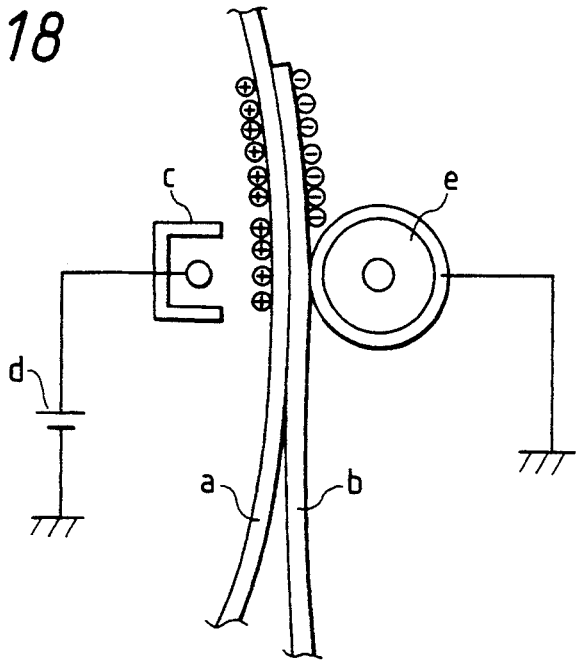
FIG. 18 is an explanatory diagram showing essential components in a conventional recording sheet conveying device.

In FIG. 17, the deflector roll 3 is shown positioned to push the recording sheet 5 against the dielectric sheet 1. However, it should be noted that the deflector roller 3 is so designed that it can be moved back and forth so that it is moved away from the transfer drum 10 after the recording sheet 5 has been retained on the latter 10. This is to prevent the deflector roll 3 from touching the recording sheet 5 on which the toner image has been transferred.

The recording sheet 5 is removed from the transfer drum 10 by means of a removing corotron 52, an internal pushing arm 53, and a removing pawl 54 as follows: First, the removing corotron 52 is activated to discharge the recording sheet 5; i.e., to eliminate the electrostatic attraction forces, and then the internal pushing arm 53 pushes the dielectric sheet 1 from inside (the inner surface) to raise the front end portion of the recording sheet 5. Under this condition, the removing pawl 54 catches the recording sheet's front end portion thus raised, to remove the recording sheet from the transfer drum 10.

The dielectric sheet 1 of the transfer drum 10 from which the recording sheet 5 has been removed is discharged by a discharging corotron 55, and then a cleaning brush 56 is operated to remove paper powder and toner from the dielectric sheet 1. The dielectric sheet thus cleaned is used to retain another recording sheet 5 on it.

In the laser printer with the recording sheet conveying device thus constructed, a color image is formed as follows:

First, image data on a color image read by an optical scanning system such as a scanner are applied to an image processing means (not shown), so that image data on one of the four colors is read out and applied to a laser write means 57 including a laser light source, a polygon mirror, a lens, etc. The photo-sensitive drum 51 is subjected to exposure by the laser write means 57, so that an electrostatic latent image is formed thereon. For instance in the case where the image data supplied is of yellow, a region of the photo-sensitive drum 51 charged uniformly by a charger 58, which is not corresponding to yellow, is subjected to exposure, and the resultant electrostatic latent image is corresponding to yellow components of the color image. The electrostatic latent image is developed by a rotary developing unit 59 comprising a yellow developing machine 59*y*, a magenta developing machine 59*m*, a cyan developing machine, and a black developing machine which are arranged at equal angular intervals. The rotary developing unit 59 is so turned that, of the developing machines, the one corresponding to the color component of an electrostatic latent image formed on the photo-sensitive drum 51 be set at a developing position in front of the photo-sensitive drum 51. The developing machine thus set forms a toner image. Therefore, in this case, the yellow developing machine 59*y* is set at the developing position, to form a yellow toner image.

On the other hand, the recording sheet 5 is sent between the transfer drum 10 and the deflector roll 3 by a register roller 60 in synchronization with the formation of the toner image, and it is electrostatically retained on the transfer drum 10 as the attracting corotron 2 is activated. As the transfer drum 10 turns, the recording sheet 5 thus retained is sent to a transfer section where the transfer drum meets the photo-sensitive drum 51. At the transfer section, the transferring corotron 61 is activated to transfer the yellow toner image from the photo-sensitive drum 51 onto the recording sheet.

The toner remaining on the photo-sensitive drum 51, which were not transferred onto the recording sheet, is removed by a cleaning unit 62, and thereafter the photo-sensitive drum 51 is charged by the charger 58 again. Similarly as in the case of the yellow toner image, a magenta toner image is formed on the photo-sensitive drum 51. In this operation, the transfer drum 10 is kept turning while holding the recording sheet 5 on which the yellow toner image has been transferred. Therefore, when the recording sheet is sent to the transfer section again, the magenta toner image is transferred on the yellow toner image.

The above-described operations are carried out also for the cyan and black components of the image data in the same manner. Thus, the toner images of four different colors are transferred onto the recording sheet 5 successively, thus providing the aimed color image.

The recording sheet 5, onto which the black toner image has been transferred, is removed from the transfer drum 10, and conveyed to a fixing unit 63, where the toner images are fixed. The recording sheet 5 thus processed is discharged from the printer into a discharge tray 65 by means of a discharging rollers 64. Thus, a series of operations for forming a color image have been accomplished.

Now, embodiments of the invention, in which the technical means of the invention are applied to the above-described recording sheet conveying device, will be described.

Figure 1:
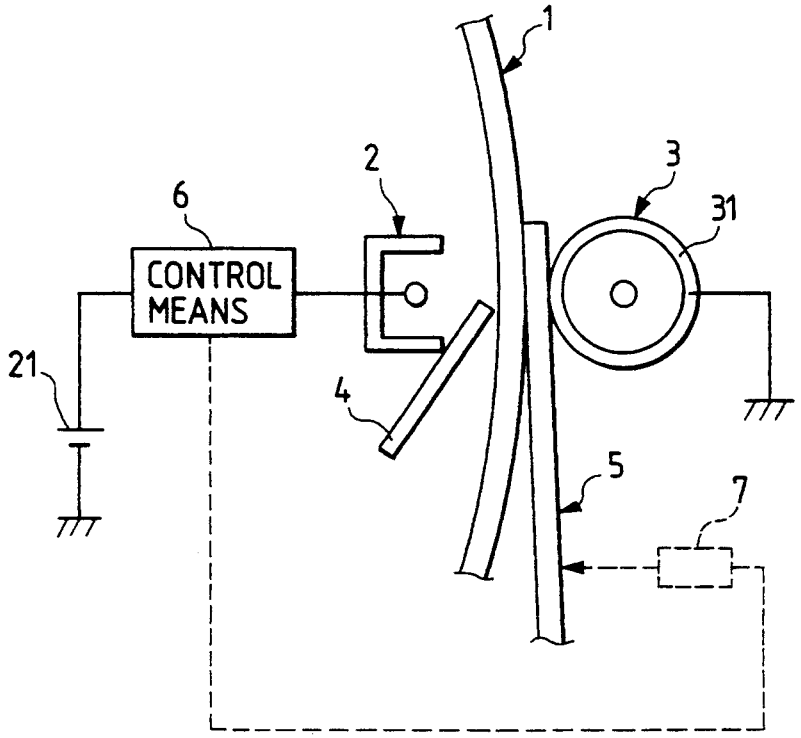
FIG. 1 is an explanatory diagram showing essential components of an example of a recording sheet conveying device, which constitutes a first embodiment of this invention.

FIG. 1 shows essential components in a first embodiment of this invention. That is, in FIG. 1, reference numeral 1 designates the above-described dielectric sheet wound on the drum body 14; 2, the above-described attracting corotron; 3, the above-described deflector roller covered with the electrically conductive layer 31; and 4, the above-described regulating plate of insulating material such as PET. In FIG. 1, the recording sheet 5 is retained on the above-described transfer drum 10.

The attracting corotron 2 is connected through control means 6 to a DC power source 21. The control means 6 operates to decrease a current flowing to the attracting corotron 2 with predetermined timing, or to interrupt the current with predetermined timing. The timing predetermined for decreasing or interrupting the current is after the front edge of the recording sheet 5 touches the dielectric sheet 1 and before the rear edge touches the latter 1.

Figure 19:
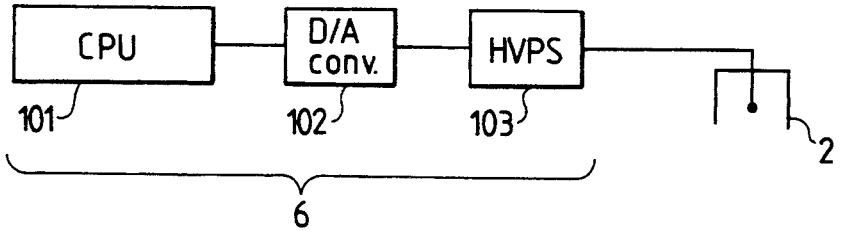
FIGS. 19 through 21 are circuit diagrams, partly as block diagrams, showing examples of control means in the first embodiment shown in FIG. 1.

A first example of the control means 6 is of the type that the output signal of the corotron is switched. The first example of the control means 6, as shown in FIG. 19, comprises: a central processing unit (CPU) 101; a digital-to-analog (D/A) converter 102; and a high voltage power source 103. The central processing unit 102 serves also as a CPU for controlling the operations of the entire copying machine. The high voltage power source 103 is such that a plurality of voltage levels are outputted by changing an input signal level. That is, in the central processing unit 101, the output signal is changed with timing shown in FIG. 3 so that the value of current of the attracting corotron is varied.

Figure 20:
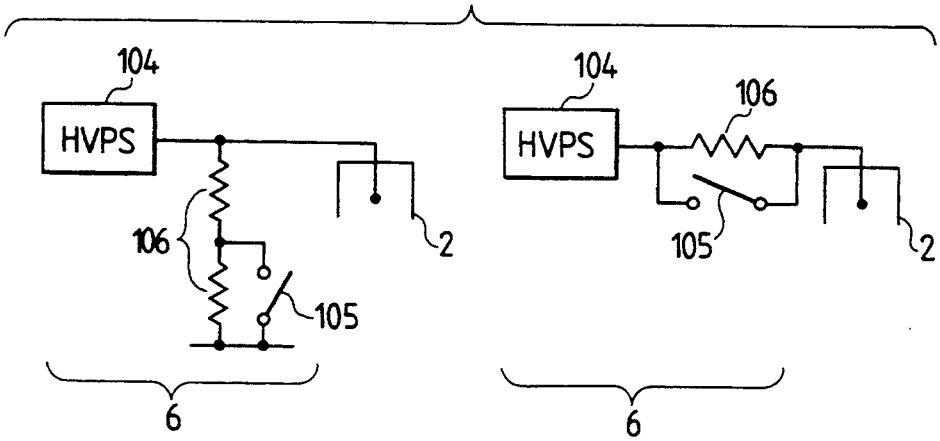

A second example of the control means 6, as shown in FIG. 20, comprises: a constant voltage power source 104; and switching means 105 and resistors 106. Those components 105 and 106 are provided between the constant voltage power source 104 and the corotron 2. In the control means 6, the power source is of constant voltage, and the output applied to the corotron is controlled on the load side. The switching means 105 is operated with predetermined timing, to control the value of current of the corotron.

Figure 21:
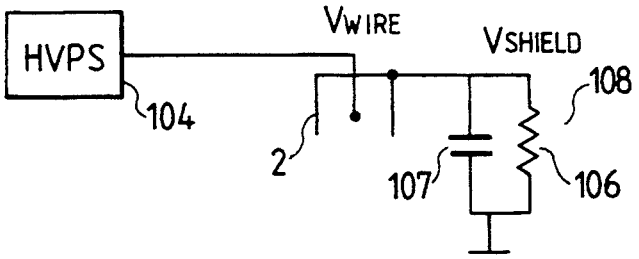
Figure 22:
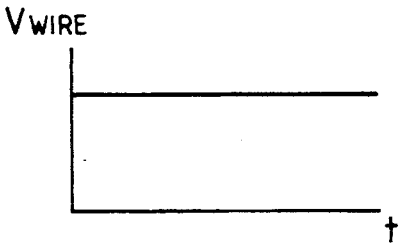
FIGS. 22 and 23 are graphical representations indicating a wire voltage applied to a corotron wire and a voltage applied to a corotron shield, respectively, in the control means shown in FIG. 21.
Figure 23:
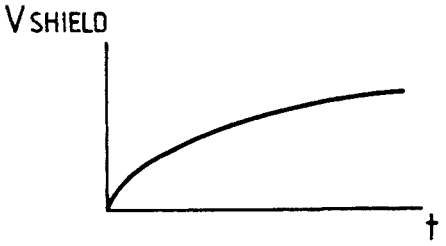

A third example of the control means 6, as shown in FIG. 21, comprises: a constant voltage power source 104; and a CR circuit 108 including a resistor 106 and a capacitor 107. The CR circuit is connected to the corotron shield. The control means 6 shown in FIG. 21 operates as follows: When the constant voltage power source 104 provides a predetermined constant voltage, a wire voltage $V_{WIRE}$ applied to the corotron wire and a voltage $V_{SHIELD}$ applied to the corotron shield change as shown in FIGS. 22 and 23, respectively. That is, after application of the constant voltage, the voltage $V_{SHIELD}$ applied to the corotron shield increases gradually, and therefore the amount of discharge by the corotron is attenuated with time. The time of attenuation can be controlled by selecting the values of the resistor 106 and the capacitor 107.

Figure 3A:
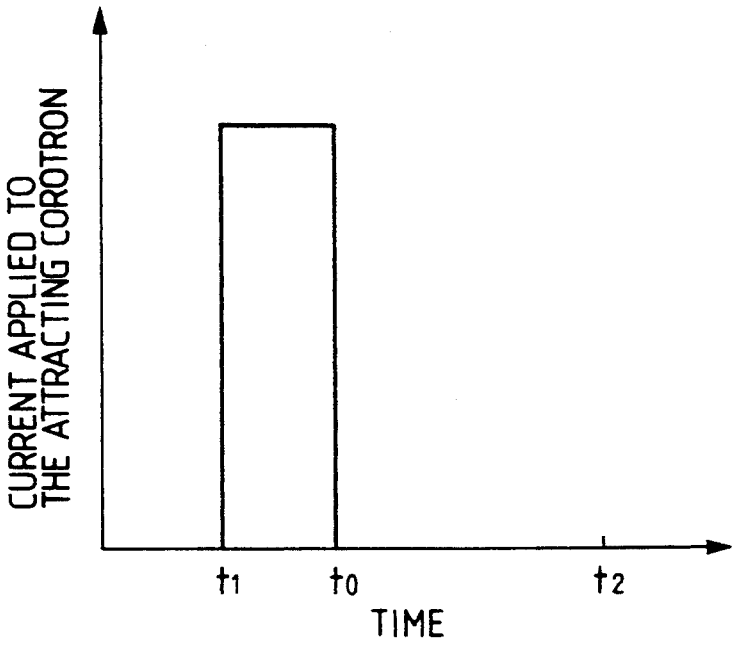
FIGS. 3(A) and 3(B) are graphical representations for a description of the timing of application of current to an attracting corotron.

FIG. 3(A) is a graphical representation indicating the timing in interruption of the current applied to the attracting corotron 2. If it is assumed that the time instant occurring immediately before the front edge of the recording sheet 5 goes into the gap between the deflector roller 3 and the dielectric sheet 1 is represented by $t_1$, and the time instant the rear edge of the recording sheet 5 passes through the same gap between the deflector roll 3 and the dielectric sheet 1 is represented by $t_2$, then the current interrupting timing is $t_0$.

When the current is interrupted while the recording sheet 5 is being electrostatically retained, in this manner, then injection of charges into the inner surface of the dielectric sheet 1 is suspended, and therefore no electrostatic attraction forces are induced between the dielectric sheet 1 and the recording sheet 5. Hence, in the case when the application of current to the attracting corotron 2 is suspended with that timing, only the predetermined front end portion A (shaded in FIG. 2) of the recording sheet is attracted to and retained on the dielectric sheet 1 by the electrostatic attraction forces.

Figure 3B:
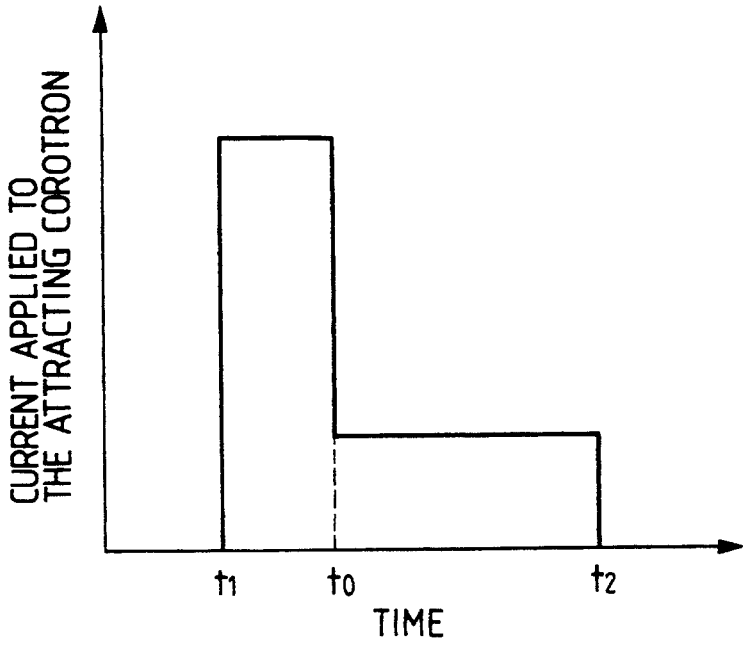

FIG. 3(B) is a graphical representation showing the timing in decreasing the current applied to the attracting corotron 2. Similarly as in the case of FIG. 3(A), the current applied to the attracting corotron 2 is decreased at the time instant $t_0$.

When the current is decreased wile the recording sheet 5 is being electrostatically retained on the dielectric sheet 1, the charges injected into the rear surface of the dielectric sheet 1 are decreased in number, and accordingly the electrostatic attraction forces acting on the dielectric sheet 1 and the recording sheet 5 are reduced. Hence, the front end portion A (shaded in FIG. 2) of the recording sheet 5 is attracted to and retained on the dielectric sheet 1 by relatively powerful electrostatic attraction forces, and the remaining portion by relatively powerless electrostatic attraction forces with some degree of freedom.

Thus, the predetermined front end portion A of the recording sheet 5 is positively retained on the dielectric sheet 1, while the remaining portion is not retained thereon, or it is retained with some degree of freedom as was described above. As a result, the recording sheet 5 is placed in close contact with the dielectric sheet 1 while being smoothed out by the deflector roll 3 beginning with the front edge. Thus, with the embodiment, the recording sheet 5 is prevented from being wrinkled when it is retained on the transfer drum 10.

The region A on which the electrostatic attraction forces act should be large enough to positively retain the recording sheet 5 on the transfer drum 10.

In the above-described first embodiment, interruption or attenuation of the current is carried out at the predetermined time instant $t_0$. However, the current may be interrupted or attenuated only when the recording sheet 5 electrostatically retained on the dielectric sheet 1 is going to be wrinkled. More specifically, this can be achieved readily by providing a recording sheet detecting sensor 7 in the recording sheet conveying path immediately before the deflector roll 3 so that the output signal of the detecting sensor 7 is applied to the control means 6.

As the recording sheet 5 electrostatically retained on the dielectric sheet 1 begins to wrinkle, it becomes greatly wavy before reaching the deflector roll 3. In this case, although the recording sheet 5 moves past the detecting sensor 7, the latter 7 outputs an "off" signal representing that no recording sheet is detected. The "off" signal is applied to the control means 6, to interrupt or decrease the current, so that the attraction force acting on the recording sheet 5 is adjusted in correspondence to the wrinkling of the recording sheet 5.

In the embodiment, the sensor 7 may be an optical range finder which is to optically detect the distance between itself and the surface of a recording sheet. In the case where the recording sheet electrostatically retained on the dielectric sheet is wrinkled, the surface of the recording sheet is no longer flat, and the distance detected by the sensor 7 varies with the degree of wariness of the recording sheet. When the distance detected by the sensor differs from a predetermined value, it is determined that the recording sheet has been wrinkled, and the output of the attracting corotron is controlled according to this determination. In this case, the above-described first or second example of the control means 6 may be employed.

Figure 4:
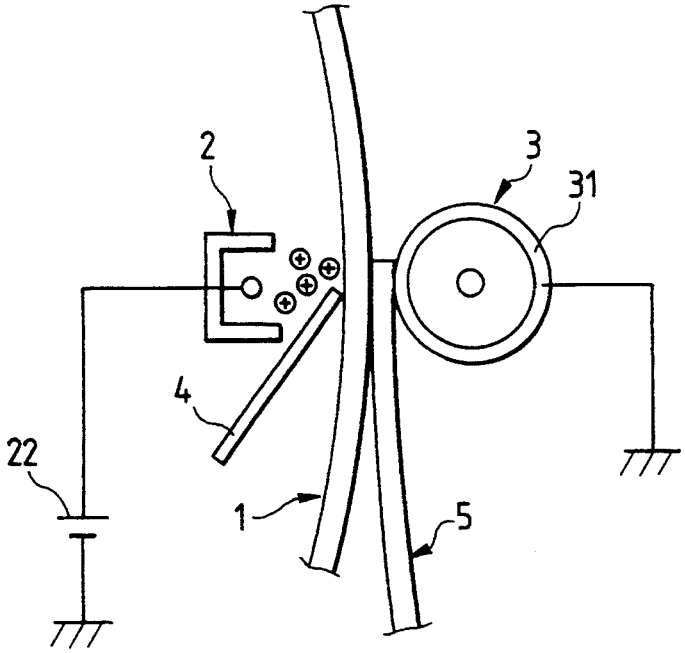
FIGS. 4(A) and 4(B) are explanatory diagrams showing essential components of another example of the recording sheet conveying device, which constitutes a second embodiment of the invention.
Figure 4:
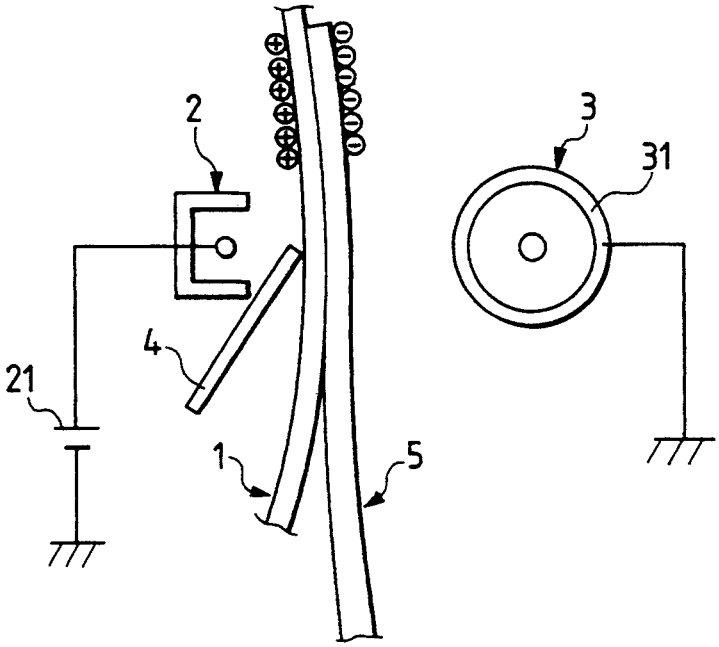

A second embodiment of the invention is as shown in FIG. 4, which, similarly as in the case of FIG. 1, shows the recording sheet 5 which is electrostatically retained on the dielectric sheet 1.

As was described before, the deflector roll 3 is so designed as to move away from the transfer drum 10 when the recording sheet 5 has been electrostatically retained on the dielectric sheet 1. In the second embodiment, the time instant when the deflector roll 3 is moved away from the transfer drum 10 occurs when a predetermined front end region of the recording sheet 5 (for instance, the region A shown in FIG. 2) is electrostatically retained on the dielectric sheet 1. As shown in FIG. 4(A), when the front end portion of the recording sheet 5 comes into the gap between the transfer drum 10 and the deflector roll 3, the latter 3 pushes the recording sheet 5 against the dielectric sheet 1; however, when the recording sheet 5 is electrostatically retained on the dielectric sheet 1 a certain length, the deflector roll 3 is moved away from the transfer drum 10 as shown in FIG.

When the deflector roll 3 is moved away from the transfer drum while the recording sheet 5 is being electrostatically retained on the dielectric sheet 1, injection of electric charges into the surface of the recording sheet 5 is suspended, and accordingly no electrostatic attraction forces are induced between the dielectric sheet 1 and the recording sheet 5, so that only the front end portion of the recording sheet 5 is electrostatically retained on the dielectric sheet 1. Hence, as the transfer drum turns, the recording sheet 5 is placed in close contact with the dielectric sheet 1 beginning with the front end portion. Thus, the recording sheet 5 held on the transfer drum 10 can be effectively prevented from being wrinkled.

Figure 24:
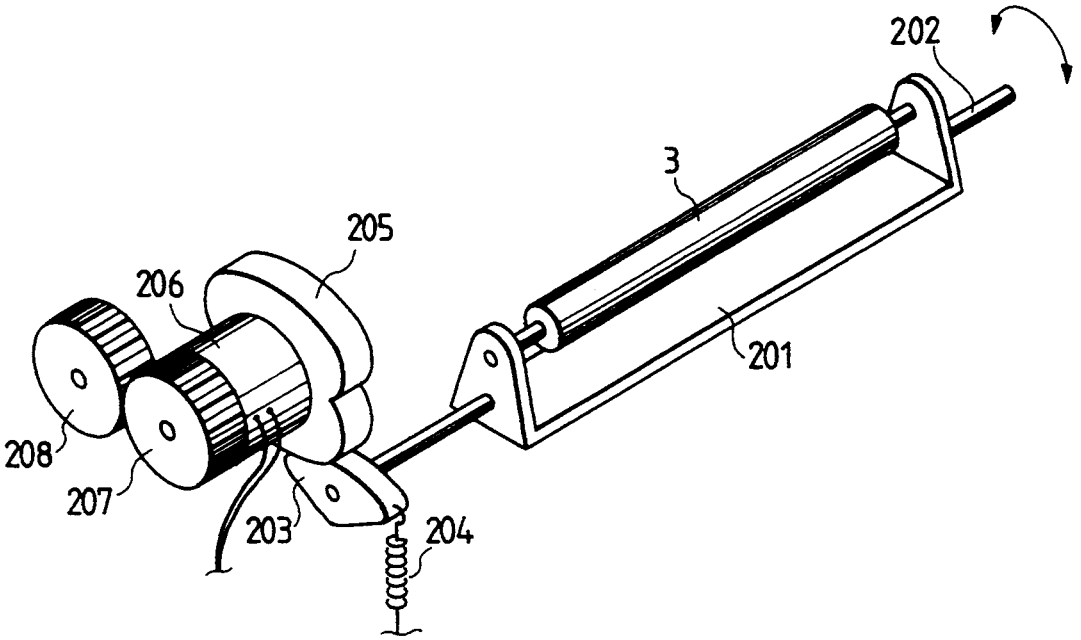
FIG. 24 is a perspective view showing means for moving a deflector roll into and out of engagement with a recording sheet in the second embodiment shown in FIG. 4.

Means for moving the deflector roll 3 into and out of engagement with the transfer drum is as shown in FIG. 24. The deflector roll 3 is rotatably supported by a deflector roll holding bracket 201 which is fixedly mounted on a rotary shaft 202. One end portion of the rotary shaft 202 is rotatably supported on a casing (not shogun), and the other end portion has a cam member 203. The cam member 203 is coupled to one end of a spring 204, the other end of which is fastened to the casing (not shown). That is, the cam member 203 is urged by the spring 204 to restore itself at all times. The cam surface of the cam member 203 is kept in contact with the cam surface of a cam member 205. The two cam members cooperate to turn the deflector roller holding bracket 201 about its rotary shaft 202 so that the deflector roll 3 is brought into and out of engagement of the transfer drum 10. The cam member 205 is coupled through an electromagnetic clutch 206 to a gear 207, which is engaged with a drive gear 208 coupled to the rotary shaft of a drive motor (not shown). In this means shown in FIG. 24, the motor drive force is kept transmitted to the gears 208 and 207 during the copying operation, and the electro-magnetic clutch 206 is controlled on and off in synchronization with a sheet detection signal or sheet conveyance.

Now, a third embodiment of the invention will be described. A specific feature of the third embodiment resides in that the device as shown in FIG. 4(A) has a deflector roll 3*a* as shown in FIG. 5.

Figure 5:
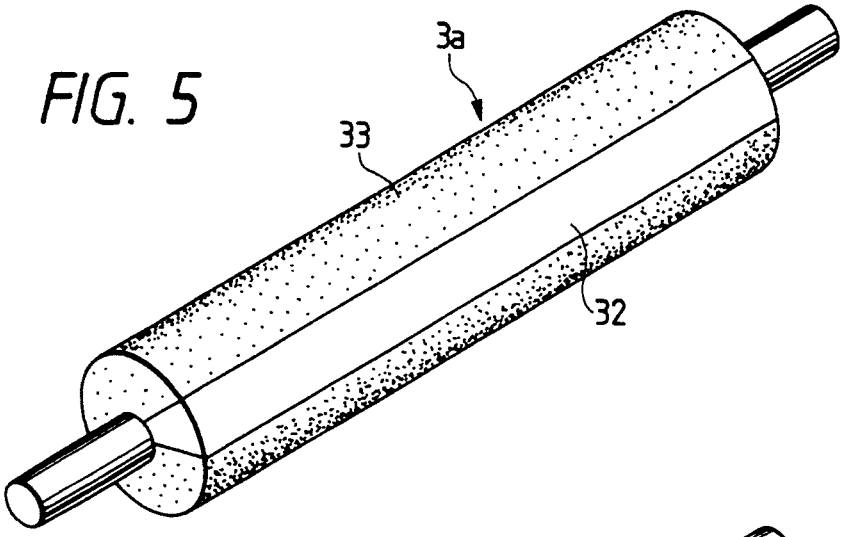
FIG. 5 is a perspective view showing a deflector roll in another example of the recording sheet conveying device, which constitutes a third embodiment of the invention.

As shown in FIG. 5, a part of the outer cylindrical wall of the deflector roll 3*a* is a belt-shaped electrically conductive layer 32 which is extended longitudinally of the latter 3*a*, and the reminding part is an insulating layer 33 (sic). The rotation of the deflector roll 3*a* is so controlled by a spring clutch (not shown) that the electrically conductive layer 32 is brought into contact with the front end portion (such as the region A shown in FIG. 2) of the recording sheet 5 conveyed thereto, and that the deflector roll 3*a* makes one revolution for each recording sheet 5.

with the deflector roll 3*a*, electric charges are injected only into the front end region of the recording sheet 5 which is brought into contact with the electrically conductive layer 32, and therefore only that region is electrostatically attracted to and retained on the dielectric sheet 1. Hence, similarly as in the case of the above-described first embodiment, the recording sheet 5 is placed in close contact with the dielectric sheet 1 while being smoothed out by the deflector roll 3*a* beginning with the front edge. Thus, with the embodiment, the recording sheet 5 is prevented from being wrinkled when it is held on the transfer drum 10.

Figure 2:
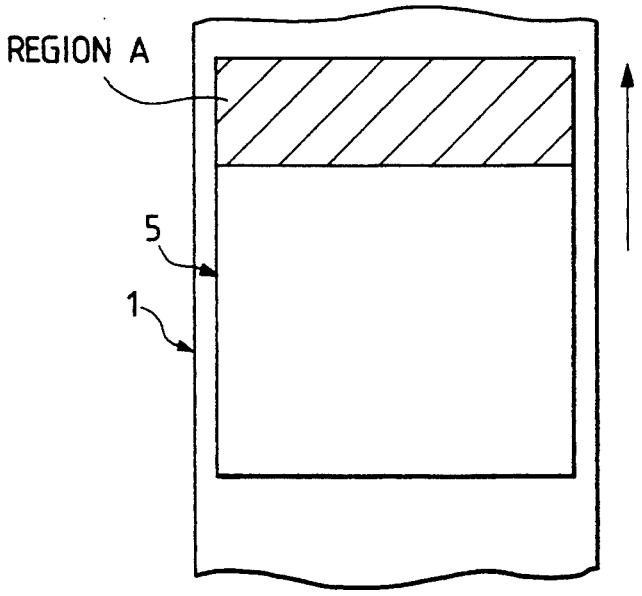
FIG. 2 is a plan view showing an attracting region A of a recording sheet which is electrostatically attracted to a dielectric sheet in the first embodiment.

In each of the above-described embodiments, as shown in FIG. 2 the front end region A of the recording sheet 5 is electrostatically attracted to and retained on the dielectric sheet 1 so that the recording sheet 5 held on the transfer drum 10 is prevented from being wrinkled. On the other hand, in the following embodiments of the invention, a belt-shaped middle portion B of a recording sheet which is along the central axis of the latter is electrostatically attracted to and retained on the dielectric sheet 1.

Figure 6:
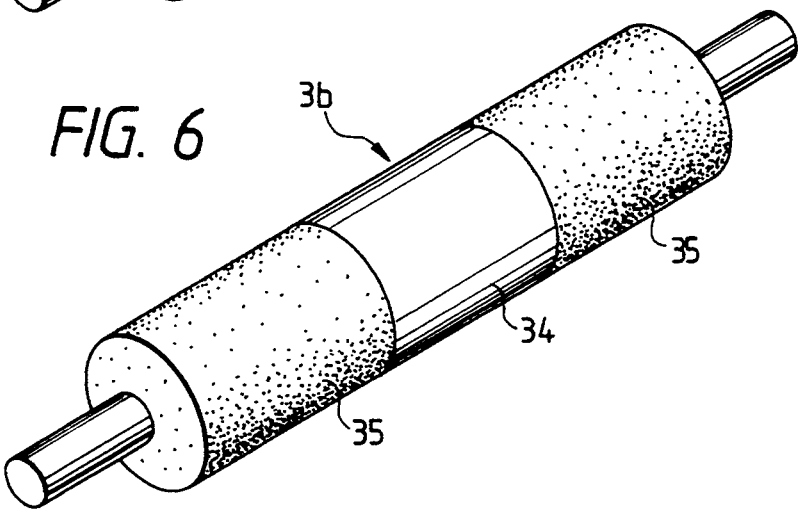
FIG. 6 is a perspective view showing a deflector roll in another example of the recording sheet conveying device, which constitutes a fourth embodiment of the invention.

FIG. 6 shows a deflector roll 3*b* employed in a fourth embodiment of the invention. The middle portion of the outer cylindrical wall of the deflector roll 3*b* is an annular electrically conductive layer 34, and the remaining two end portions are insulators 35.

Figure 7:
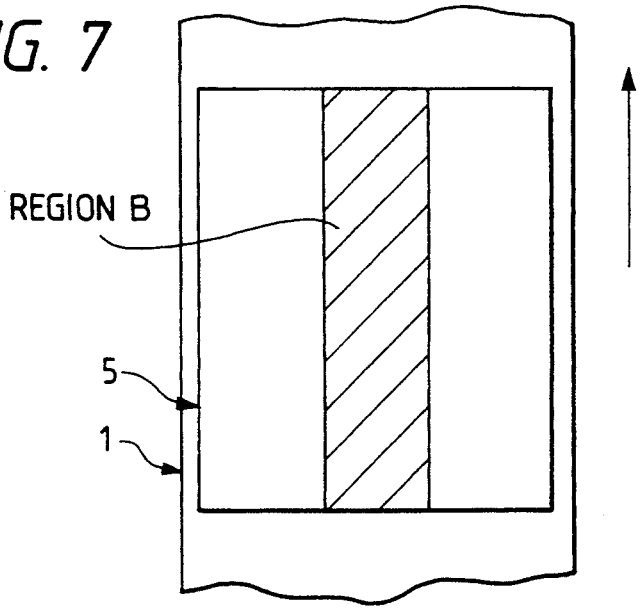
FIG. 7 is a plan view showing an attracting region B of a recording sheet in the fourth embodiment.

With the deflector roll 3*b*, electric charges are injected only into the belt-shaped middle portion (the middle region B shaded in FIG. 7) of the recording sheet 5 which is brought into contact with the electrically conductive layer, and therefore only the region is attracted to and retained on the dielectric sheet 1 by electrostatic attraction forces induced therebetween. Hence, the recording sheet 5 is set in close contact to the dielectric sheet 1 in such a manner that it is stretched from the belt-shaped middle region attracted to the dielectric sheet 1 towards both sides. Thus, with the embodiment, the recording sheet 5 is prevented from being wrinkled when it is held on the transfer drum 10.

The insulators 35 forming both end portions of the deflector roll 3*b* may be provided as follows: An electrically conductive layer is formed on the entire outer cylindrical wall of the deflector roll, and both end portions of the electrically conductive layer thus formed are subjected to surface treatment, or wrapped with insulating tape.

Figure 8:
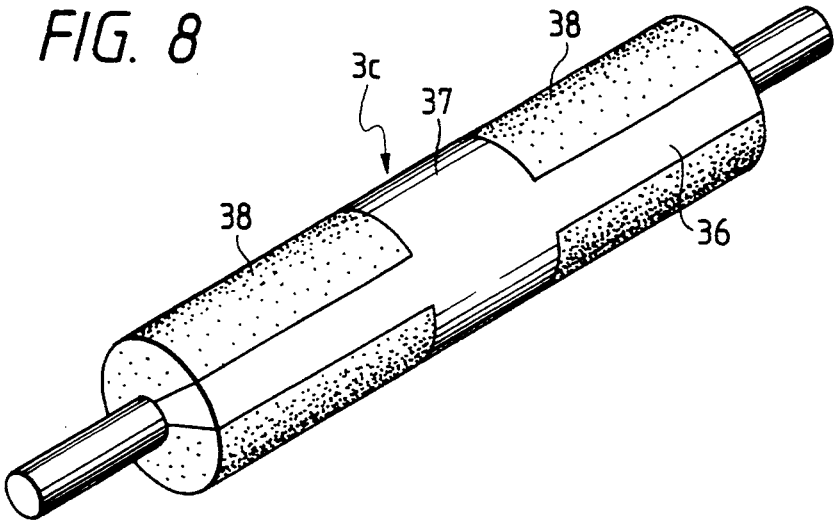
FIG. 8 is a perspective view showing a deflector roll in another example of the recording sheet conveying device, which constitutes a fifth embodiment of the invention.

FIG. 8 shows a deflector roll 3*c* employed in a fifth embodiment of the invention.

The deflector roll 3*c* is a combination of the deflector roll 3*a* shown in FIG. 5 and the deflector roll 3*b* shown in FIG. 5. That is, in the outer cylindrical wall of the deflector roll 3*c*, an elongated electrically conductive layer 36, and an annular electrically conductive layer 37 are formed in such a manner that the former layer 36 is extended longitudinally of the roll and the latter layer 37 is located at the middle of the roll, and the remaining are insulators 38.

Figure 9:
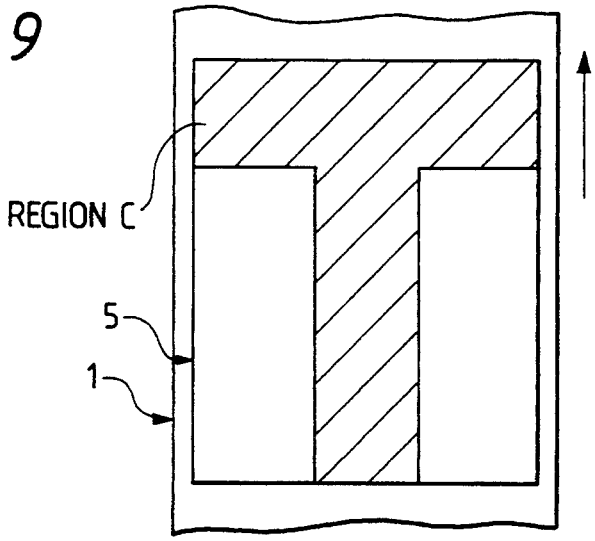
FIG. 9 is a plan view showing an attracting region C of a recording sheet in the fifth embodiment.

Similarly as in the case of the third embodiment, the rotation of the deflector roll 3*c* is so controlled that the elongated electrically conductive layer 36 is brought into contact with the front end portion of the recording sheet 5. In this case, as shown in FIG. 9, electric charges are injected only into the T-shaped region C of the recording sheet 5 which is brought into contact with the conductive layers 36 and 37, so that the T-shaped region C is electrostatically attracted to and retained on the dielectric sheet 1.

Thus, the recording sheet is placed in close contact with the dielectric sheet 1 while being stretched beginning with the front edge, and therefore it is effectively prevented from being wrinkled. The rear end portion of the recording sheet 5 will never flap when the transfer drum turns on which the recording sheet 5 has been set, because the middle of the rear end portion of the recording sheet 5 has been electro-statically attracted to and retained on the dielectric sheet 1.

Figure 10:
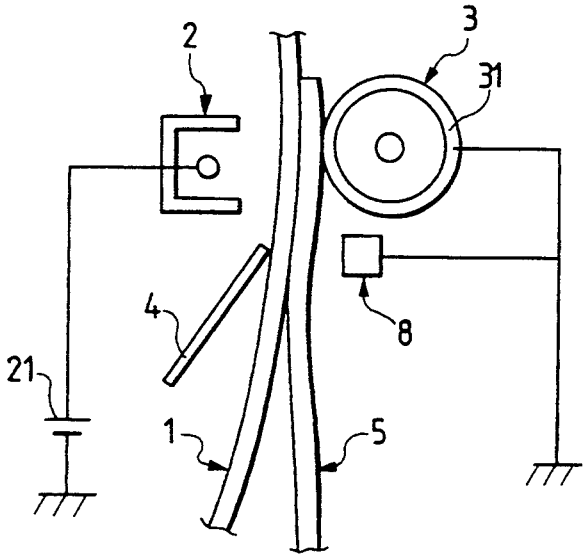
FIG. 10 is an explanatory diagram showing essential components in another example of the recording sheet conveying device, which constitutes a sixth embodiment of the invention.
Figure 11:
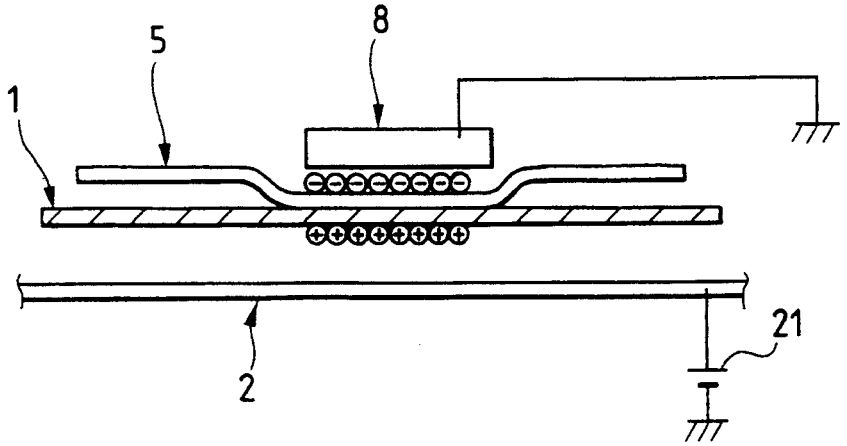
FIG. 11 is an explanatory diagram showing a recording sheet which is electrostatically attracted to a dielectric sheet in the sixth embodiment.

FIGS. 10 and 11 show a sixth embodiment of the invention.

A specific feature of the sixth embodiment resides in that a precedence electrode 8 is positioned immediately before the deflector roll 3 in such a manner as to cover the middle of the deflector roll 3, and, similarly as in the case of the deflector roll 3, the precedence electrode 8 is grounded.

Hence, in the sixth embodiment, electric fields are formed between the precedence electrode 8 and the attracting corotron 2 as well as between the deflector roll 3 and the attracting corotron 2, so that electric charges are injected into the recording sheet 5 also by the precedence electrode 8. Since the precedence electrode 8 is arranged at the middle of the deflector roll 3 as viewed longitudinally of the latter, the region into which electric charges are injected by the precedence electrode 8 is a belt-shaped one extended along the central axis of the recording sheet 5 (such as the middle region B shown in FIG. 7). Therefore, the belt-shaped middle region of the recording sheet 5 is electrostatically attracted to and retained on the dielectric sheet 1 earlier than the remaining regions as shown in FIG. 11. Thereafter, the whole area of the recording sheet 5 is electrostatically attracted to and retained on the dielectric sheet 1 by means of the deflector roll 3.

In this case, the recording sheet 5 is electrostatically attracted to and retained on the dielectric sheet 1 in such a manner that it is stretched outwardly from the middle. Thus, the recording sheet 5 is prevented from being wrinkled when held on the transfer drum 10.

Figure 12:
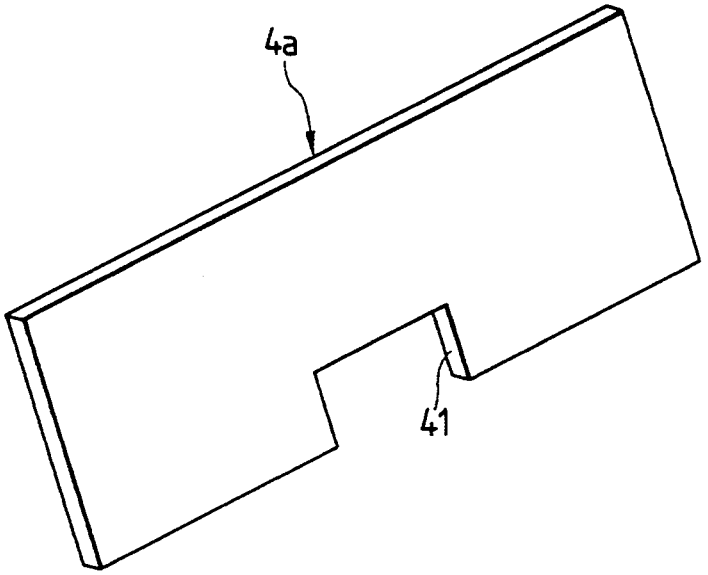
FIG. 12 is a perspective view showing a regulating plate in another example of the recording sheet conveying device, which constitutes a seventh embodiment of the invention.
Figure 13:
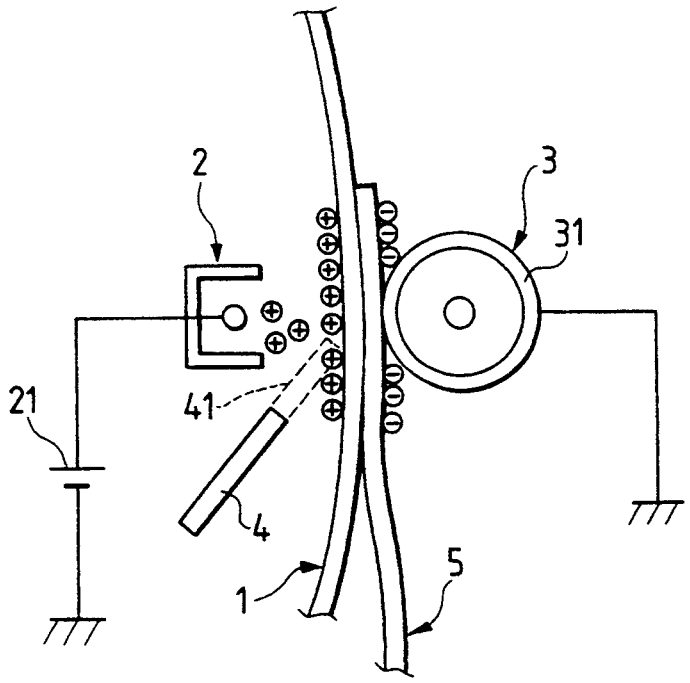
FIG. 13 is an explanatory diagram showing essential components in the seventh embodiment.

FIGS. 12 and 13 show a seventh embodiment of the invention.

A specific feature of the seventh embodiment resides in that a regulating plate 4*a* as shown in FIG. 12 is employed; that is, the regulating plate 4*a* has a cut 41 formed in one side portion of a regulating plate 41 at the middle, and it is arranged in such a manner that its one side portion having the cut 41 abuts against the rear surface of the dielectric sheet 1.

The regulating plate 4*a* supports the dielectric sheet 1 from behind where the deflector roll 4 abuts against the recording sheet 5, thus covering a part of the front of the attracting corotron 2. As was described before, the regulating plate is made of an insulating material. In the above-described embodiments, no electric charges are injected into the part of the dielectric sheet 1 which is shielded from the attracting corotron 2 by the regulating plate 4, and accordingly no electrostatic attractive forces are induced on this side of the position where the regulating plate 4 abuts against the dielectric sheet 1. On the other hand, in the seventh embodiment, electric charges are injected into the dielectric sheet 1 through the cut 41 formed in the regulating plate 4*a*. In this case, since the cut 41 is formed in the one side portion of the regulating plate 4*a* at the middle as was described above, the electric charges emitted through the cut 41 are injected into the elongated middle region, in the direction of width, of the dielectric sheet 1. Accordingly, on the side of the outer surface of the recording sheet, electric charges are injected into the belt-shaped middle portion in correspondence to the cut 41 of the regulating plate 4*a* more that to the remaining portions. As a result, the belt-shaped middle portion of the recording sheet 5 is electrostatically attracted to and retained on the dielectric sheet 1 earlier. When the recording sheet 5 passes through the position where the regulating plate 4*a* abuts against the dielectric sheet 1, it is, in its entirety, electrostatically attracted to and retained on the dielectric sheet 1.

In the seventh embodiment, similarly as in the sixth embodiment, the recording sheet 5 is electrostatically attracted to and retained on the dielectric sheet 1 in such a manner that it is stretched outwardly from the middle. Thus, the recording sheet 5 is prevented from being wrinkled when held on the transfer drum 10.

In the seventh embodiment, the regulating plate 4*a* has the cut 41. However, the same effect may be obtained by forming a through-hole in the regulating plate substantially at the same position as the cut 41.

Figure 14:
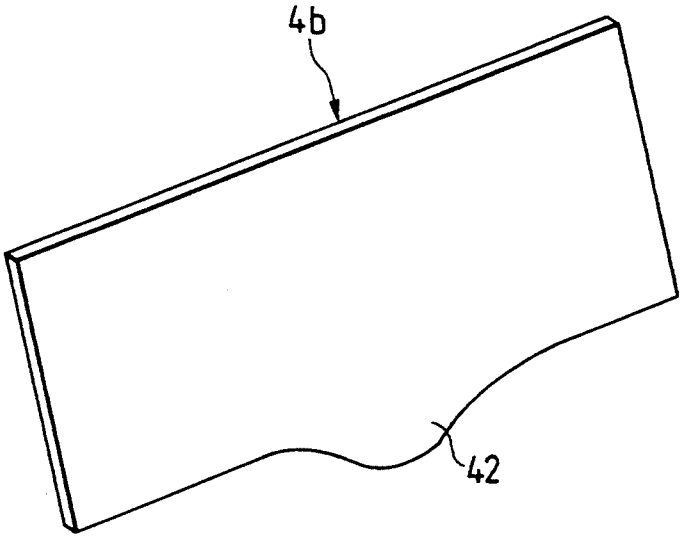
FIG. 14 is a perspective view showing a regulating plate in another example of the recording sheet conveying device, which constitutes an eighth embodiment of the invention.
Figure 15:
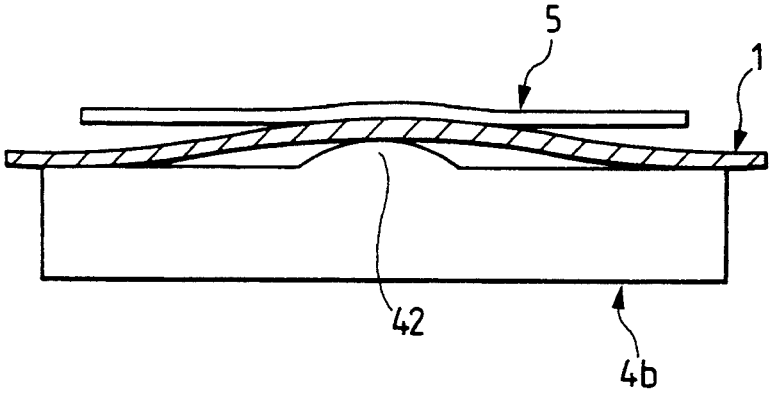
FIG. 15 is an explanatory diagram showing a recording sheet pushed against a dielectric sheet by the regulating plate in the eighth embodiment.

FIGS. 14 and 15 show an eighth embodiment of the invention. A specific feature of the eighth embodiment resides in that, as shown in FIG. 14, its regulating plate 4*b* has a protrusion 42 extended from the middle of its one side, and the regulating plate 4*b* is so arranged that the protrusion 41 is abutted against the inner surface of the dielectric sheet 1. Hence, the middle portion, in the direction of width, of the dielectric sheet 1 is curved towards the deflector roll 3, so that the middle portion, in the direction of width, of the recording sheet 5 is electrostatically attracted to and retained on the dielectric sheet 1 earlier than the remaining. Therefore, in the eighth embodiment, too, the recording sheet 5 is electrostatically attracted to and retained on the dielectric sheet 1 in such a manner that it is stretched outwardly from the middle. Thus, the recording sheet 5 is prevented from being wrinkled when held on the transfer drum.

As was described above, in each of the above-described embodiments, the recording sheet 5 can be electrostatically retained on the transfer drum 10 without forming wrinkles. Therefore, in the color laser printer, toner images can be transferred from the photosensitive drum 51 onto the recording sheet with high efficiency, and the resultant color images are excellent in picture quality.

As is apparent from the above description, with the recording sheet conveying device according to the invention, the recording sheet is electrostatically attracted to and retained on the dielectric sheet in such a manner that it is stretched beginning with its front end portion, or outwardly from its middle portion. Hence, the recording sheet is positively prevented from being wrinkled when retained on the dielectric sheet.

While there has been described in connection with the preferred embodiments of this invention, it will be obvious to those skilled in the art that various changes and modifications may be made therein without departing from the invention, and it is aimed, therefore, to cover in the appended claims all such changes and modifications as fall within the true spirit and scope of the invention.

What is claimed is:

1. A recording sheet conveying device comprising:

a dielectric sheet which moves at a predetermined speed while electrostatically retaining a recording sheet on the outer surface thereof;

a charger positioned on a side of the inner surface of said dielectric sheet, said charger adapted to induce electrostatic attraction forces between said dielectric sheet and said recording sheet;

a deflector roll having an electrically conductive layer as an outer surface thereof, said deflector roll being confronted with said charger and adapted to push said recording sheet against said dielectric sheet; and control means, operating said charger to adjust the number of electric charges, in spite of differences in dielectric constant between successive ones of said recording sheet during recording, to weaken electrostatic attraction forces acting on the rear end portion of said recording sheet and to strengthen electrostatic attraction forces acting on the front end portion of said recording sheet.

2. A recording sheet conveying device as claimed in claim 1, which further comprises:

a sensor located immediately before a position where said recording sheet is electrostatically attracted to and retained on said dielectric sheet;

said sensor detecting an irregular condition of said recording sheet to output a detection signal, which actuates said control means for adjustment of the number of electric charges provided by said charger.

* * * * *